US006583574B2

(12) United States Patent
Ann et al.

(10) Patent No.: US 6,583,574 B2
(45) Date of Patent: Jun. 24, 2003

(54) POWER SAVER FOR DISCHARGE LAMPS

(75) Inventors: Jae Hyuck Ann, Taejon (KR); Kyung Sook Cho, 317 Jagyo-ri, Goduk-myon, Pyung Taek City, Kyunggi-do (KR)

(73) Assignee: Kyung Sook Cho, Kyunggi-do (KR)

( * ) Notice: Subject to any disclaimer, the term of this patent is extended or adjusted under 35 U.S.C. 154(b) by 0 days.

(21) Appl. No.: 10/014,493

(22) Filed: Dec. 14, 2001

(65) Prior Publication Data

US 2002/0101192 A1 Aug. 1, 2002

(30) Foreign Application Priority Data

Dec. 26, 2000 (KR) ..... 10-2000-0036387

(51) Int. Cl.[7] ..... H05B 37/02; H05B 41/16
(52) U.S. Cl. ..... 315/149; 315/360; 315/278
(58) Field of Search ..... 315/354, 278, 315/360, 276, 274, 307, 222, 211, 291 R, 149, 284, 242

(56) References Cited

U.S. PATENT DOCUMENTS 4,336,490 A * 6/1982 Lewis ..... 323/256
5,477,113 A * 12/1995 Christoffersson ..... 307/140
5,508,589 A * 4/1996 Archdekin ..... 315/141
5,623,186 A * 4/1997 Archdekin ..... 315/149
6,191,568 B1 * 2/2001 Poletti ..... 315/360

* cited by examiner

*Primary Examiner*—Don Wong
*Assistant Examiner*—Chuc Tran
(74) *Attorney, Agent, or Firm*—Troxell Law Office PLLC

(57) ABSTRACT

A power saver for discharge lamps, in which supply of electricity is not stopped instantaneously even though applied voltage is converted into lower voltage after lighting the discharge lamp, is disclosed. The power saver for discharge lamps includes a first coil, a second coil having a winding direction opposed to a winding direction of the first coil and located in an opposite direction of the first coil, an insulator located at a gap part where the first coil and the second coil are opposed, at least one or more taps arranged along a longitudinal direction of the second coil, at least one or more switches selectively connected to one of the taps, at least one or more first timers connected to the switches respectively, an electric relay mounted in a loop circuit including both end parts of the second coil, and a second timer connected to the electric relay. At the time of an initial power supply, current flows through only the first coil because the switches are all opened and the discharge lamp is lighted in a state that the electric relay is shut, and each timer is operated to shut each switch when a prescribed period of time passes after lighting of the discharge lamp is finished by the current.

2 Claims, 5 Drawing Sheets

POWER SAVER FOR DISCHARGE LAMPS

BACKGROUND OF THE INVENTION

1. Field of the Invention

The present invention relates to a power saver for discharge lamps, and more particularly, to a power saver used in discharge lamps.

2. Background of the Related Art

Fluorescent lamps, mercury lamps, natrium lamps, metal lamps and so on are generically called discharge lamps because using light obtained through electric discharge after the electric discharge is made by gas filling the inside of the lamp.

Such discharge lamp generally needs a predetermined voltage of 220V or 100V to start the electric discharge. However, the discharge lamp can radiate light without any trouble even though lower voltage is applied to the discharge lamp to maintain the electric discharge after the discharge lamp is discharged and lighted. Therefore, for example, a large-sized sign board using 1400~1500 natriums at once has a considerable power-saving effect when voltage is applied at 80~90% of initial voltage in the discharge maintaining step.

In consideration of the above, a power saver, which shows the power-saving effect by applying lower voltage after starting electric discharge by supplying voltage of 220V (or 110V) when a discharge lamp is lighted, and applies lower voltage to the discharge lamp after completing the electric discharge, thereby showing power-saving effect, has been well known. However, the power saver of the above type is a simple form to which an automatic transformer is applied. Such power saver cannot be spread widely because it happens very often that supply of electricity is instantaneously cut off and the discharge lamp does not lighted again after being lighted out when voltage is converted into lower voltage after starting the discharge.

SUMMARY OF THE INVENTION

Accordingly, the present invention is directed to a power saver for discharge lamps that substantially obviates one or more problems due to limitations and disadvantages of the related art.

An object of the present invention is to provide a power saver for discharge lamps in which supply of electricity is not cut off and of which volume is small and manufacturing expenses are inexpensive even though applied voltage is converted into lower voltage after the discharge lamp is lighted.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a power saver for discharge lamps including a first coil, a second coil having a winding direction opposed to a winding direction of the first coil and located in an opposite direction of the first coil, an insulator located at a gap part where the first coil and the second coil are opposed, at least one or more taps arranged along a longitudinal direction of the second coil, at least one or more switches selectively connected to one of the taps, at least one or more first timers connected to the switches respectively, an electric relay mounted in a loop circuit including both end parts of the second coil, and a second timer connected to the electric relay. At the time of an initial power supply, current flows through only the first coil because the switches are all opened and the discharge lamp is lighted in a state that the electric relay is shut, and each timer is operated to shut each switch when a prescribed period of time passes after lighting of the discharge lamp is finished by the current.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. For your understanding, first, a conventional power saver for discharge lamps will be described.

Figure 1:
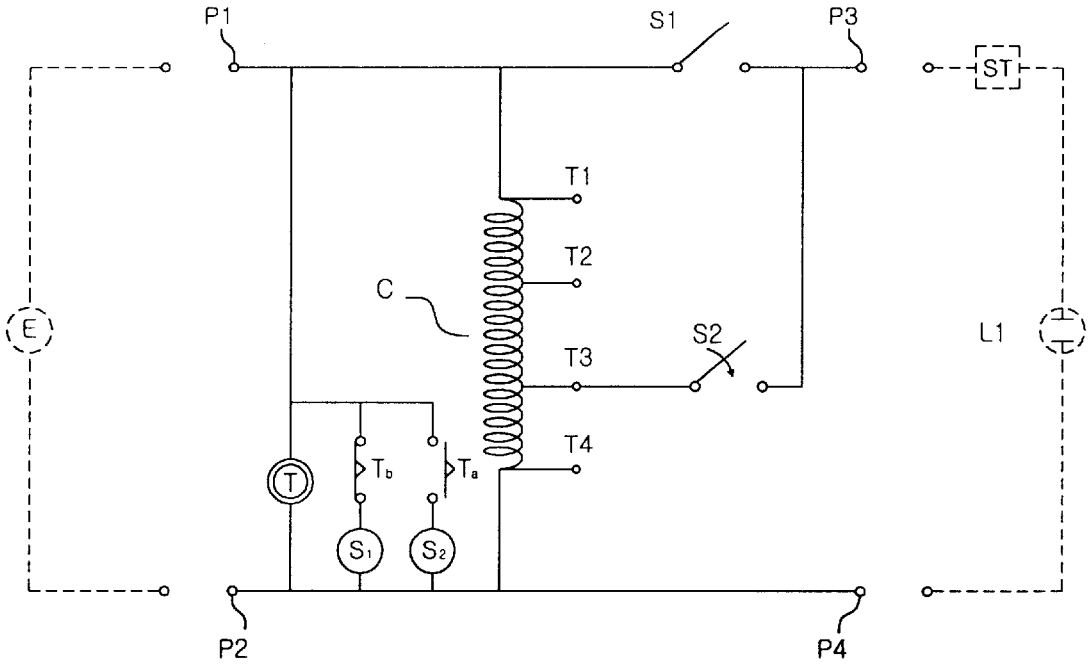
FIG. 1 illustrates a circuit diagram of a conventional power saver for discharge lamps.

FIG. 1 illustrates a simple circuit diagram of an inner structure of the conventional power saver for discharge lamps applying an automatic transformer. The conventional power saver for discharge lamps includes only one coil C and a plurality of taps T1, T2, T3 and T4 arranged along a longitudinal direction of the coil C. The circuit of the conventional power saver for discharge lamps includes first and second switches S1 and S2, and the second switch S2 is connected to one predetermined tap (tap T3 in FIG. 1) of the above taps. As shown in a dotted line in the drawing, a pair of terminals P1 and P2 are connected to an external power supply system E and another pair of terminals P3 and P4 are connected to a discharge lamp L1. The reference mark ST designates a stabilizer, and the first and second switches S1 and S2 are connected to a timer (T).

In such power saver for discharge lamps, the first switch S1 is shut and the second switch S2 is open in an initial stage for lighting the discharge lamp. Therefore, when electric power is applied from the external power supply system, the discharge lamp L1 is charged with electricity through the circuit including the first switch S1, thereby starting the electric discharge. When the electric discharge of the discharge lamp L1 is finished and lighted, the first switch S1 is opened and the second switch S2 is shut by the operation of the timer (T). Here, the coil C serves as an automatic transformer. When the first switch S1 is opened and the second switch 2 is shut, voltage after passing the automatic transformer, i.e., the coil C, is lowered compared with voltage applied from the outside. As described above, because the plurality of taps T1, T2, T3 and T4 are mounted in the coil C, the strength of voltage is changed according to whether the second switch S2 is connected to which tap. As the result, the strength of voltage is changed according an available winding number of the coil.

However, in such power saver for discharge lamps, because a branch circuit including the coil C is short-circuited and damaged in a condition that the first and second switches S1 and S2 are simultaneously shut, it must be always kept that the first switch S1 is first opened and then the second switch S2 is shut when the first and second switches S1 and S2 are converted in their opening and shutting. Therefore, the supply of electricity is cut off instantaneously when the first and second switches S1 and S2 are converted in their opening and shutting, and at this time, it happens frequently that the discharge lamp is lighted off and is not lighted again.

Hereinafter, various preferred embodiments of a power saver for discharge lamps according to the present invention applying the automatic transformer to solve the above problems will be described.

Figure 2:
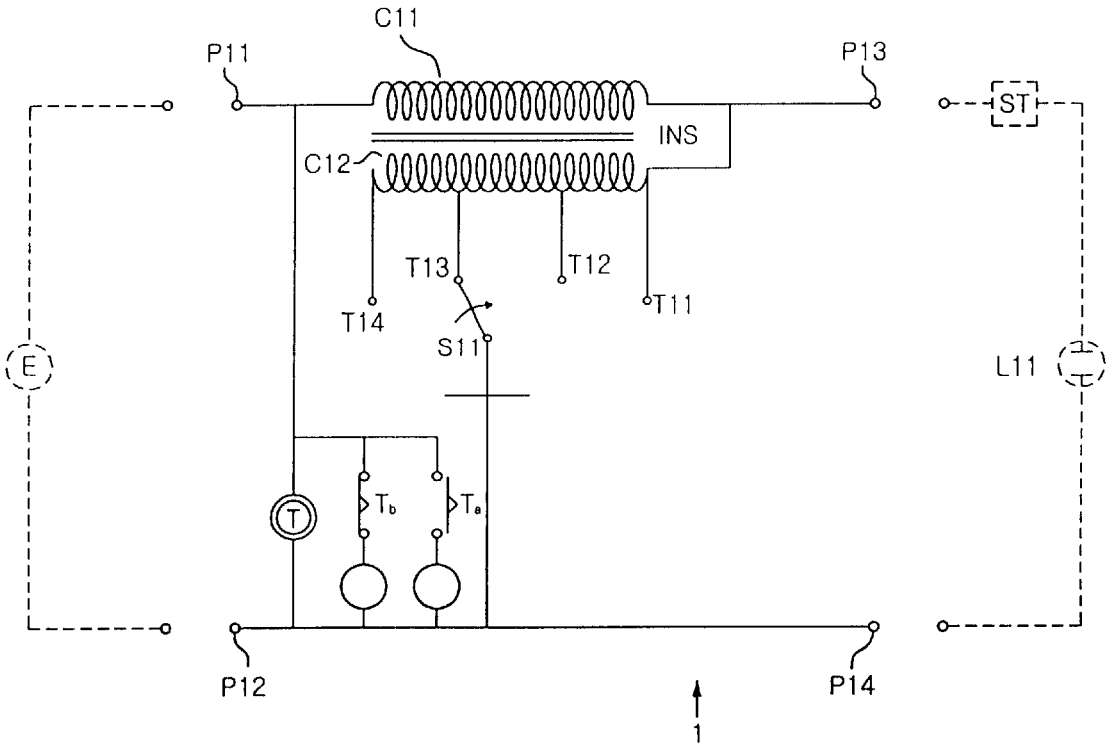
FIG. 2 illustrates a circuit diagram of a power saver for discharge lamps according to a first preferred embodiment of the present invention.
Figure 3:
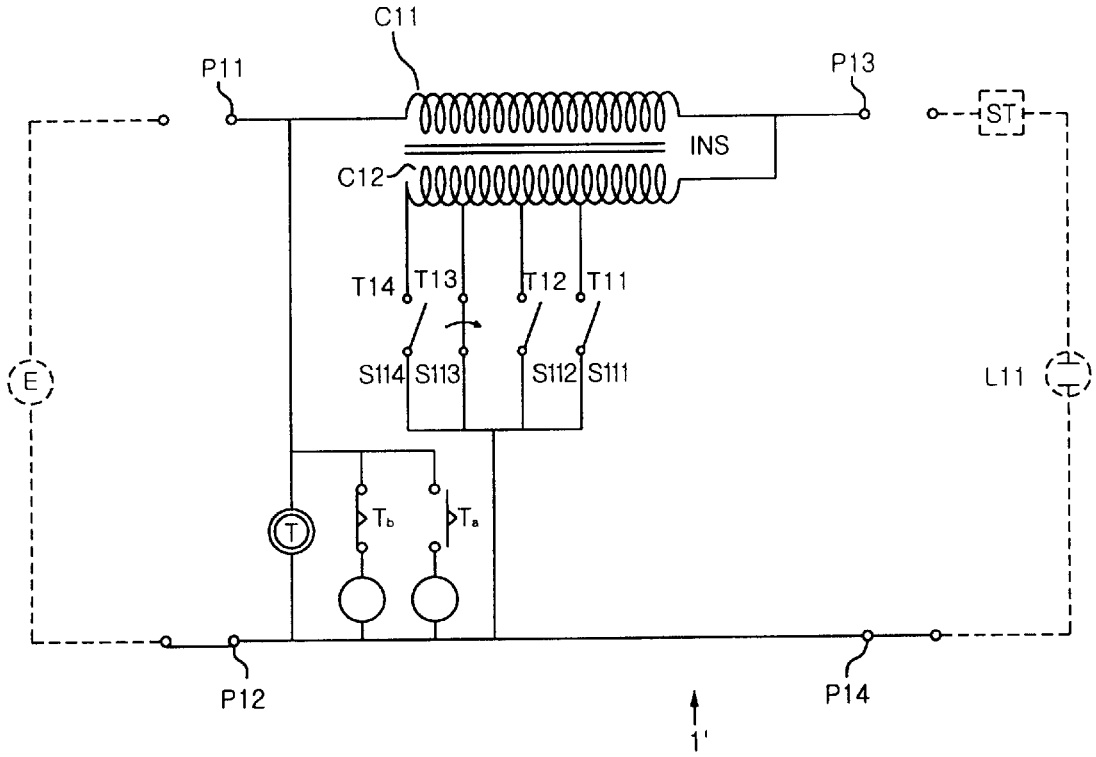
FIG. 3 illustrates a circuit diagram of a modification of the power saver for discharge lamps according to the first preferred embodiment.

FIG. 2 illustrates a power saver 1 for discharge lamps according to a first preferred embodiment of the present invention, and FIG. 3 illustrates a modification 1' of the first preferred embodiment. As shown in the drawings, because the power saver 1 includes a pair of coils C11 and C12 having different directions from each other and an insulator INS located at the center thereof, and the pair of coils C11 and C12 serve as the automatic transformer having subtractive polarity.

At least one or more taps T11, T12, T13 and T14 are mounted along a longitudinal direction of the second coil C12, and one of the taps (tap T13 in the drawings) is connected to a switch S11. In case that the plurality of taps are mounted in the second coil C12, that the switch is connected to which tap is determined according to whether voltage for maintaining the electric discharge is set at what percent of the initially applied voltage. Furthermore, in case that only one tap is mounted to the second coil C12, that the tap is mounted at which place of the second coil C12 is also determined according to whether voltage for maintain the electric discharge is set at what percent of the initially applied voltage. This will be described in more detail as follows.

A pair of terminals P11 and P12 are connected to the external power supply system E shown in the dotted line in the drawing, and another pair of terminals P13 and P14 are connected to a discharge lamp L11. The reference mark ST designates a stabilizer, and a switch S11 is connected to a timer (not shown).

The switch S11 is opened in an initial stage for lighting the discharge lamp, and therefore, when power supply is applied from the outside, the electric discharge of the discharge lamp L11 is started through a closed circuit (hereinafter, called "main circuit") including the first coil C11, but the second coil C12 is not charged with electricity. Like that, when the discharge lamp L11 is lighted, electricity continuously flows through the main circuit in a state that the switch S11 is shut, because a switch corresponding to the first switch S1 shown in FIG. 1 does not exist. Therefore, the circuit is not instantaneously opened or the discharge lamp L11 is not lighted out.

Continuously, the moment the switch S11 is short-circuited by the operation of the timer, the switch S11 is connected to one predetermined tap of the taps. The switch S11 is naturally connected to one preset tap when the second coil C12 has only one tap. However, means for selecting or changing a tap to be connected with the switch must be provided in case that the second coil has the plural taps. It is preferable that the selecting means is a selector switch as shown in FIG. 2. Alternatively, as shown in FIG. 3, it will be appreciated that a plurality of switches S111, S112, S113 and S114 corresponding to the number of the taps are mounted and only one predetermined tap of them is shut.

If the switch S11 (or one of the switches S111 through S114) is short-circuited, the coils C11 and C12 serve as the automatic transformer, and the coils C11 and C12 generate induction voltage to the second coil C12 due to a winding direction different from each other. The strength of induction voltage may be changed according to whether the switch is connected to which tap of the taps T11 through T14, as being changed according to a winding ratio of the first coil C11 and the second coil C12.

For example, in this specification, a winding part of the first coil C11 is designated as $n_1$ and the number of the whole windings of the second coil C12 is designated as $n_2$. The number of the taps is N. If the N taps are arranged at regular intervals, the winding number between the taps is $n_2/(N-1)$. In this embodiment shown in the drawing, four taps are mounted and the switches S11 and S113 are connected to the third tap T13. In this case, the available winding number of the second coil becomes $n_2\times(2/3)=2n_2/3$. In other words, as the wining ratio of the first coil C11 and the available second coil C12 becomes $n_1/[2n_2/3]=3n_1/2n_2$ the strength of the induction voltage becomes $3n_1/2n_2\times E$ (induction voltage). Therefore, after the switches S11 and S23 are shut, voltage corresponding to the difference between the induction voltage and the applied voltage is supplied to the discharge lamp L11 through the main circuit. Because the strength of the induction voltage is changed according to whether the switch is connected to which tap of the taps T11 through T14, voltage supplied to the discharge L11 is lower than the applied voltage E.

Figure 4:
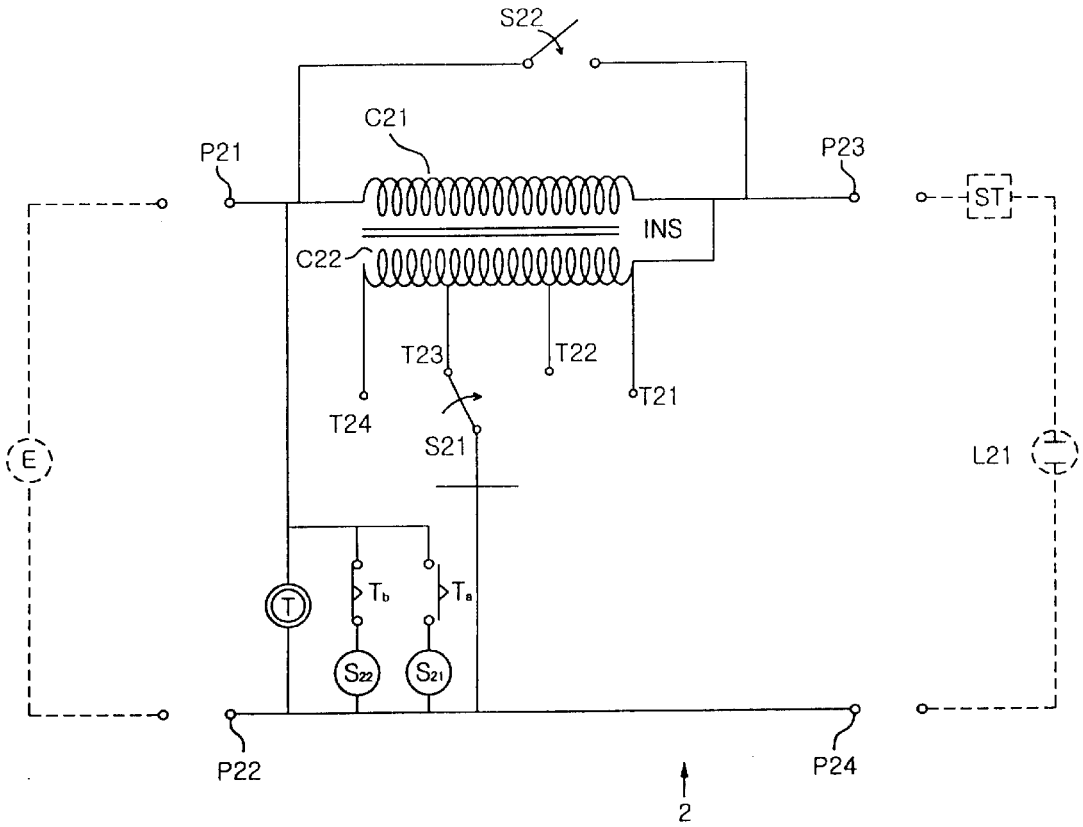
FIG. 4 illustrates a circuit diagram of a power saver for discharge lamps according to a second preferred embodiment of the present invention.

FIG. 4 illustrates a power saver 2 for discharge lamps according to a second preferred embodiment of the present invention. The power saver 2 for discharge lamps according to the second preferred embodiment is similar to the power saver 1 of the first preferred embodiment shown in FIG. 2. In other words, in the same way of the power saver 1 for discharge lamps according to the first preferred embodiment, also the power saver 2 for discharge lamps of the second preferred embodiment includes a pair of coils C21 and C22 having a different winding direction from each other and an insulator INS mounted at the center thereof. Furthermore, a plurality of taps T21, T22, T23 and T24 are mounted to the second coil C22, and a switch (hereinafter, called a "first switch") S21 selectively connected to one of the taps T21 through T24. Moreover, a pair of terminals P21 and P22 are connected to an external power supply system E shown in a dotted line in the drawing, and another pair of terminals P23 and P24 are connected to a discharge lamp L21. The reference mark ST designates a stabilizer, and a switch S21 is connected to a timer (T).

However, a difference between the power saver 2 of the second embodiment and the power saver 1 of the first embodiment is that another switch (hereinafter, called a "second switch") S22 coupled to the timer (T) is added to a circuit including the first coil C22. The power saver 2 of the second embodiment can have the same effect as the power saver 1 of the first embodiment even though the switch S22 is added to the power saver 2 of the second embodiment. That is, even though the power saver 2 of the second embodiment is used, the circuit is not opened instantaneously or the discharge lamp is not lighted out, and voltage lower than the applied voltage can be continuously supplied to the discharge lamp.

In more detail, the first switch S21 is opened and the second switch S22 is short-circuited in an initial stage for lighting the discharge lamp L21. Therefore, power supply applied from the outside is applied to the discharge lamp L21 with voltage of the same level as the applied voltage E through a closed circuit including the second S22, but the second coil C22 is not charged with electricity. When the discharge lamp L21 is lighted, the first switch S21 is short-circuited and the second switch S22 is opened by the operation of the timer (T). The circuit is not opened instantaneously or the discharge lamp L21 is not lighted off because voltage lower than the applied voltage E is continuously supplied to the discharge lamp L21 through the first coil C21 even though the first switch S21 is short-circuited and the second switch S22 is opened.

As described above, when the second switch S22 is opened and the first switch S21 is short-circuited, voltage lower than the applied voltage E is continuously supplied to the discharge lamp L21 in the same way as the power saver 1 of the first embodiment. The reason is that the coils C21 and C22, which are components of the power saver 2 for discharge lamps, serve as the automatic transformer having subtractive polarity in the same way as that of the power saver 1 of the first embodiment. Therefore, because the strength of induction voltage is changed according to whether the switch S22 is connected to which tap of the taps T21 through T24, also voltage supplied to the discharge lamp L21 is supplied in a lower level than the applied voltage E. Additionally, it is not shown in the drawings, but it will be appreciated that a modification, which is the same as the modification of the power saver 1 of the first embodiment (see FIG. 3) may be applied to the power saver 2 for discharge lamps of the second embodiment. That is, switches are mounted corresponding to the number of the taps of the power saver 2 for discharge lamps of the second embodiment, and only one predetermined tap is shut.

Figure 5:
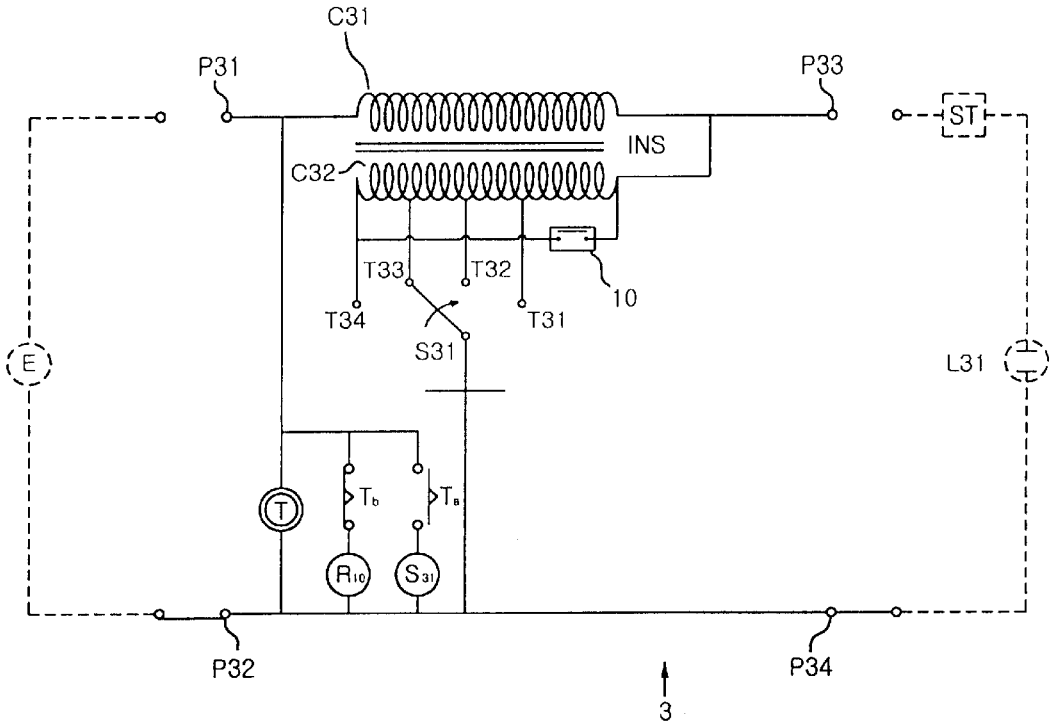
FIG. 5 illustrates a circuit diagram of a power saver for discharge lamps according to a third preferred embodiment of the present invention.

FIG. 5 illustrates a power saver for discharge lamps according to a third preferred embodiment of the present invention. As shown in FIG. 5, the power saver 3 for discharge lamps of the third embodiment is similar to the power saver 2 for discharge lamps of the second embodiment. In other words, the structure of the power saver 3 for discharge lamps is the same as the power saver 2 for discharge lamps besides the second switch S22, and the same as the power saver 1 for discharge lamps of the first embodiment. Therefore, the structure of the power saver 3 for discharge lamps of the third embodiment, which is the same as the power saver 2 for discharge lamps of the second embodiment will not be described.

However, the power save 3 for discharge lamps of the third embodiment has an electric relay 10 serving the same function as the second switch S22 mounted in the power saver 2 for discharge lamps of the second embodiment. The electric relay 10 performs the same function as the second switch S22 but has advantages that its volume is small in volume and expenses are inexpensive. Therefore, the third embodiment shows the power saver for discharge lamps using the electric relay 10, which is small in volume and inexpensive in expenses, instead of the second switch S22 (for example, a magnetic switch), which is large in volume and somewhat expensive in expenses.

Referring to FIG. 5, the power saver 3 for discharge lamps according to the third embodiment will be described in more detail as follows. The power saver 3 for discharge lamps has the same structure as the power saver 2 for discharge lamps of the first embodiment, and the same structure as the power saver 2 for discharge lamps besides the second switch S22. The electric relay 10 is mounted between a second coil C32 and one (tap T34 in the drawing) of taps T31 through T34, and a timer (T) is connected to the electric relay 10.

In the above structure, a switch S31 is opened and the electric relay 10 is short-circuited in an initial stage for lighting a discharge lamp L31. Therefore, when power supply is applied from the outside, the discharge lamp L31 is discharged through a closed circuit including a first coil C31 and the electric relay 10, but a second coil C32 is not charged with electricity. When the discharge lamp L31 is lighted, a switch S31 is short-circuited and the electric relay 10 is opened by the operation of the timer (T). The circuit is not opened instantaneously or the discharge lamp L31 is not lighted out because voltage is continuously supplied to the discharge lamp L31 through the first coil C31 even though the electric relay 10 is opened and the switch S31 is short-circuited.

As described above, when the electric relay 10 is opened and the switch S31 is short-circuited, voltage lower than the applied voltage E is continuously supplied to the discharge lamp L31 in the same way as the power savers 1 and 2 of the first and second embodiments. The reason is that the coils C31 and C32, which are components of the power saver 3 for discharge lamps, serve as the automatic transformer having subtractive polarity, in the same way as the power savers 1 and 2 of the first and second embodiments. Therefore, because the strength of induction voltage is changed according to whether the switch S31 is connected to which tap of the taps T31 through T34, also voltage supplied to the discharge lamp L31 is supplied in lower level than the applied voltage E. Furthermore, it is not shown in the drawings, but it will be appreciated that a modification, which is the same as the modifications of the power savers 1 and 2 of the first and second embodiments may be applied to the power saver 3 for discharge lamps of the third embodiment. That is, switches are mounted corresponding to the number of the taps of the power saver 3 for discharge lamps of the second embodiment, and only one predetermined tap is shut.

In the above description, for your understanding, four taps are arranged at regular intervals, but the number of the taps may be selected according to a user's desire, and the arrangement of the taps is not restricted to the regular interval and the taps may be arranged at discretionary intervals to make a prescribed output voltage (difference between the applied voltage and induction voltage) possible.

Moreover, if you want not to adjust output voltage at need but to fix in a set voltage, only one tap may be mounted. In this case, that the one tap is mounted at which place of the second coil may be determined in such a manner that the strength of induction voltage is calculated from desirable output voltage (that is, induction voltage=applied voltage−desirable output voltage), and available winding number is calculated back from it.

As described above, according to the present invention, because the switches S11, S21 and S31 are opened in the initial stage for discharging and lighting the discharge lamp, the applied voltage is supplied to the discharge lamp in the same level or lower level, and thereby the electric discharge is made without any trouble. After the electric discharge, the switches are shut, and voltage lower than the applied voltage is continuously supplied to the discharge lamp by generating induction voltage by the pair of coils, thereby obtaining good power-saving effect.

As described above, the power saver for discharge lamps has the power-saving effect by applying voltage lower than the applied voltage in the process for maintaining the electric discharge and the radiation of the discharge lamp after lighting and discharging the discharge lamp by the applied voltage from the outside. Additionally, in the power saver according to the present invention, the discharge lamp is not lighted out because the circuit maintains the electrically charged condition without opening of the circuit even though voltage is changed from the discharge starting stage to the discharge maintaining stage.

Differently from the conventional power saver applying the principle of the automatic transformer, the power saver for discharge lamps according to the present invention is more stable and has excellent power-saving effect because compensating loss using the principle of the automatic transformer.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A power saver for discharge lamps comprising:

a first coil;

a second coil having a winding direction opposed to a winding direction of the first coil, the second coil being located in an opposite direction of the first coil;

an insulator located at a gap where the first coil and the second coil are opposed;

at least one tap arranged along a longitudinal direction of the second coil;

at least one first switch selectively connected to one of the at least one tap;

a second switch mounted in a loop circuit including both end parts of the first coil; and a timer connected to the first and second switch, wherein in the taps and the first switches, only one switch is connected to only one tap at the same time, and wherein at the time of an initial power supply the discharge lamps are in a lighted state, the first switches are all opened and the second switch is shut, and the timer is operated to shut one of the first switches and to open the second switch when a prescribed period of time passes after lighting of the discharge lamp is finished by the current.

2. A power saver for discharge lamps comprising:

a first coil;

a second coil having a winding direction opposed to a winding direction of the first coil, the second coil being located in an opposite direction of the first coil;

an insulator located at a gap where the first coil and the second coil are opposed;

at least one tap arranged along a longitudinal direction of the second coil;

at least one switch selectively connected to one of the at least one taps;

an electric relay mounted in a loop circuit including both end parts of the second coil; and a timer connected to the at least one switches and the electric relay, wherein only one switch is connected to only one tap at the same time, and wherein at the time of an initial power supply, the discharge lamp is lighted in a state that the electric relay is shut, and the timer is operated to shut one of the switches and to open the electric relay when a prescribed period of time passes after lighting of the discharge lamp is finished by the current.

* * * * *